US005983436A

United States Patent [19]

Mason et al.

[11] Patent Number: 5,983,436

[45] Date of Patent: Nov. 16, 1999

[54] BODY LOTION APPLICATOR

[76] Inventors: Andrew R. Mason; Sandra L. Lauachus, both of 3942 N. Paulina, Chicago, Ill. 60613

[21] Appl. No.: 08/972,618

[22] Filed: Nov. 18, 1997

[51] Int. Cl.[6] ..... A47K 7/04

[52] U.S. Cl. ..... 15/222; 15/209.1; 401/6

[58] Field of Search ..... 15/208, 209.1, 15/222; 401/6, 8, 201

[56] References Cited

U.S. PATENT DOCUMENTS

| | | | |
|---|---|---|---|
| 1,404,401 | 1/1922 | Novick . | |
| 2,035,014 | 3/1936 | Schaefer . | |
| 2,730,745 | 1/1956 | Norman . | |
| 3,364,511 | 1/1968 | Martin | 15/222 |
| 3,674,374 | 7/1972 | Jennings . | |
| 3,720,205 | 3/1973 | Liebman . | |
| 3,959,841 | 6/1976 | Horne . | |
| 3,977,796 | 8/1976 | Gillespie et al. . | |
| 4,422,205 | 12/1983 | Braxter, Sr. . | |
| 4,698,854 | 10/1987 | Slimmon | 15/222 |
| 4,761,849 | 8/1988 | Taylor | 15/222 |
| 5,013,171 | 5/1991 | Almond, II . | |
| 5,035,523 | 7/1991 | Allinder . | |
| 5,097,822 | 3/1992 | Francis et al. . | |
| 5,251,990 | 10/1993 | Vought et al. . | |
| 5,736,213 | 4/1998 | Meier | 15/222 |

*Primary Examiner*—Terrence R. Till
*Attorney, Agent, or Firm*—Welsh & Katz, Ltd.

[57] ABSTRACT

An applicator device for applying lotion or the like to one's body, and particularly the back, includes an elongated generally rectangular strip of flexible microfiber material having opposite ends to which hand-grippable handles are connected by elastic members, whereby a lotion may be applied to the strip and then to one's back by grasping the handles and manipulating the strip over the back. The elastic members enable the user to readily vary the contact pressure applied by the strip against the back.

9 Claims, 1 Drawing Sheet

BODY LOTION APPLICATOR

BACKGROUND OF INVENTION

The present invention relates generally to lotion applicators, and more particularly to a novel body lotion applicator that finds particular application in applying a body lotion to one's back.

Devices are known which enable a person to apply a cleaner, such as soap, or a lotion to an area of the body that is generally difficult to access with one's hands or a hand-held wash cloth, such as a major portion of the back. The known applicator devices are generally characterized as having an elongated flexible strip of fabric material that may have multiple layers and has one or more pockets formed therein to receive soap or the like. Hand grippable handles, frequently formed by fabric loops or the like, enable the user to grasp opposite ends of the applicator and extend it across his/her back in a manipulating movement. Representative examples of such prior applicators are disclosed in U.S. Pat. Nos. 1,404,401 (Novick), 2,035,014 (Schaefer), 2,730,745 (Norman) 3,674,374 (Jennings), 3,720,205 (Liebman), 3,959,841 (Horne), 3,977,796 (Gillespie) and 4,422,205 (Braxter).

More recent lotion applicators of the aforedescribed type have included features that are believed to enhance their effectiveness in applying a lotion to the user's back. See, for example, U.S. Pat. Nos. 5,013,171 (Almond), 5,035,523 (Allinder) and 5,251,990 (Vought et al.)

A drawback in the prior lotion applicators of the aforedescribed type intended to enable application of lotion or the like to the user's back is that they are of relatively fixed length. This can lead to difficulty in efficiently using a fixed length applicator by person's of different size who must grasp the ends of the applicator and try to manipulate it behind their back. Accordingly, an applicator of the type having an elongated strip of fabric-like material operative to receive a lotion for application to one's back, and having hand-grippable handles connected to opposite ends of the strip through elastic members so as to more readily enable use by person's of different size and arm length, while also enabling the user to easily vary the contact pressure applied by the applicator to the body, would provide significant advantages over the known prior applicators for applying a lotion or the like to hard-to-reach areas of the body.

SUMMARY OF THE INVENTION

A general object of the present invention is to provide a novel applicator that finds particular use in applying a lotion or the like to the user's back.

A more particular object of the present invention is to provide a novel applicator for applying a lotion or the like to one's back and that employs an elongated strip of fabric having interstitial cavities opening outwardly of at least one surface of the strip to receive a lotion for application to the back, the applicator having hand-grippable handles connected to opposite ends of the strip through elastic connector members that enable the user to readily vary the contact pressure applied by the fabric strip against the user's back while grasping the handles.

Another object of the present invention is to provide a novel applicator for applying lotion to one's back and which is simple in construction and relatively inexpensive to manufacture.

A feature of the applicator in accordance with the present invention lies in making the lotion applying strip from a microfiber material that allows a lotion to be readily kneaded into the fabric and then self-applied to one's back by grasping the handles and manipulating the elongated strip over the area of the back.

Another feature of the invention lies in the use of generally loop-shaped elastic members releasably connected to opposite ends of the lotion applying fabric strip and on which hand grips are mounted whereby the user can readily vary the pressure applied by fabric strip against the user's back when manipulating the strip over the back.

A further feature of the lotion applicator in accordance with the invention lies in releasably attaching the elastic members to opposite ends of the fabric strip so as to enable easy detachment of the elastic members and hand grips for cleaning the fabric strip.

Further objects, advantages and features of the lotion applicator in accordance with the present invention will become apparent from the following detailed description of the invention taken in conjunction with the accompanying drawing wherein like reference numerals designate like elements throughout the several views.

DETAILED DESCRIPTION

Figure 1:
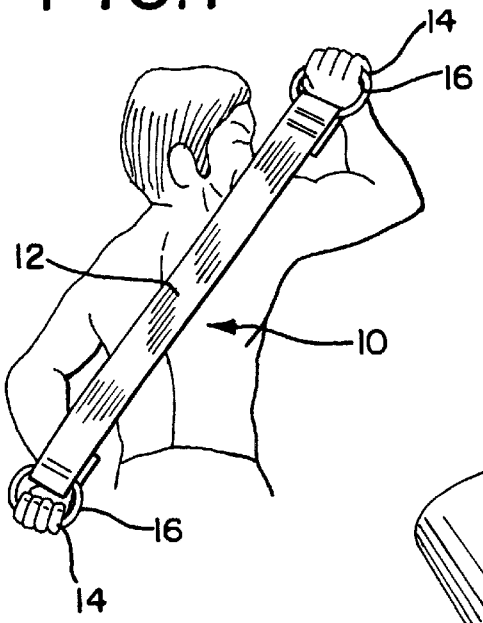
FIG. 1 is a fragmentary perspective view illustrating use of the lotion applicator in accordance with the present invention to apply a lotion or the like to one's back.

Referring now to the drawing, an applicator device that finds particular application in applying lotion or the like to one's body, and particularly one's back, in accordance with the present invention is indicated generally at 10. The applicator device 10, which may be referred to as a lotion applicator, includes an elongated generally rectangular strip of flexible but relatively non-extendable fabric material 12 having hand grips or handles 14 releasably secured to opposite ends of the strip through elastic connector members 16. The lotion applicator 10 may also be used to apply a cleaner, such as liquid soap, to the user's back. As illustrated schematically in FIG. 1, the applicator is gripped between the user's hands so that the fabric strip 12 extends across the back and can be manipulated both longitudinally and laterally to apply a lotion or other liquid type material to the user's back. In this manner, areas of the back that are otherwise inaccessible to the user's hands, or very difficult to reach, can be accessed for applying a lotion or cleaning solution to the back.

The fabric strip 12 is made of a longitudinal length such that when the handles 14 and elastic members 16 are secured to its opposite ends, the handles or grips may be readily engaged by the user's hands in the manner as illustrated in FIG. 1. The strip 12 may comprise a single layer or folded multiple-layer fabric strip preferably having a transverse width of approximately 3–4 inches. The fabric strip 12 is preferably made from a microfiber material having ultra-fine fibers that define interstitial cavities dispersed through the material and wherein a substantial number of the interstitial cavities intersect or open outwardly of at least one, and preferable both, of the opposite surfaces of the strip. One example of a microfiber material that may be employed to make the strip 12 is commercially available from the Britanne Corporation, San Francisco, Calif., under its tradename AQUIS. The fabric strip 12 enables a lotion, such as a body lotion, to be applied to a desired area of the strip and kneaded into the fabric so that subsequent contacting the fabric strip against the user's back will cause the lotion to be applied to the contacted skin surface. The interstitial cavities comprise relatively minute voids created within and between the fabric fibers capable of receiving and holding a flowable liquid body lotion when poured onto and kneaded into the fabric strip 12. The lotion is retained within the fabric by capillary action but is released in large part when the fabric strip contacts the skin.

Figure 2:
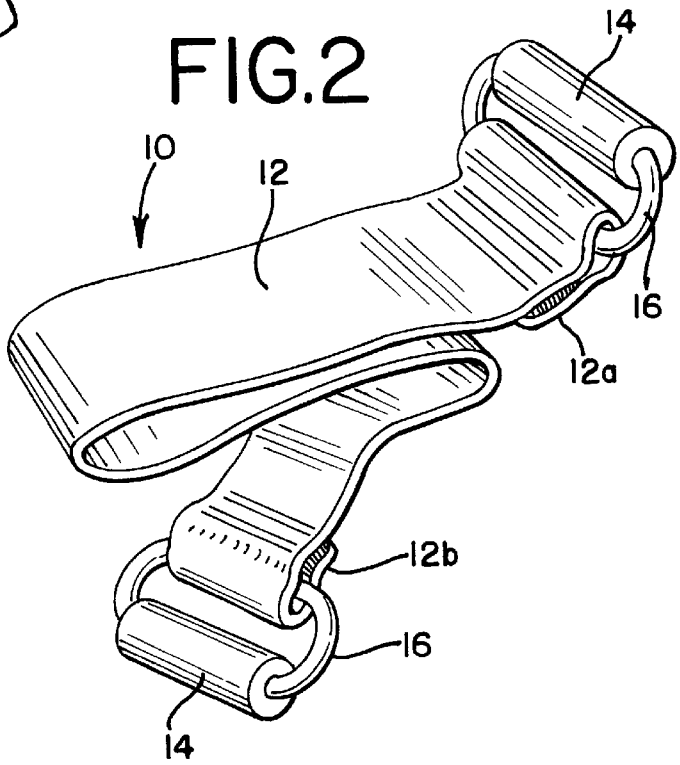
FIG. 2 is a perspective view of the lotion applicator of FIG. 1 in a partially folded condition.
Figure 3:
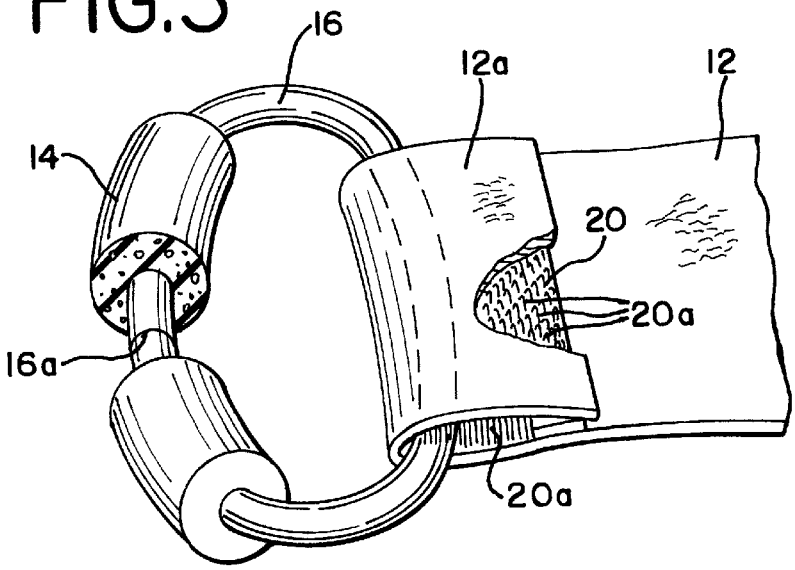
FIG. 3 is a fragmentary perspective view, on an enlarged scale, illustrating an end of the lotion applicator of FIG. 2, with portions broken away for purposes of clarity.

As illustrated in FIGS. 2 and 3, the opposite ends of the fabric strip 12 are adapted to be folded back upon themselves so as to form loop ends generally transverse to the longitudinal axis of the strip, as indicated at 12*a* and 12*b*. Suitable fastener means are formed on or secured to the opposite ends of the fabric strip 12 in a manner to enable the outermost ends of the strip to be folded back upon themselves and releasably secured to establish loop ends. In the illustrated embodiment, the fastening means associated with each of the opposite ends of the strip 12 comprises a fastener wherein a strip 20 of closely spaced upstanding hook-type elements 20*a* is secured on a predetermined length of the fabric so that when the end is turned back upon itself with the exposed surfaces of the strip in juxtaposed relation, the opposed surfaces will engage and releasably secure to each other in a known manner. One example of a material for forming the strip fastener 20 is commercially available under the trademark VELCRO. Alternatively, each of the opposite ends of the fabric strip 12 may have other conventional fastening means thereon, such as snaps or buttons or the like, which enable releasable connection of the free end when looped back upon itself.

In forming the loop ends of the fabric strip 12, an elastic member in the form of a generally endless or closed loop elastic member 16 is first placed on each end of the strip so as to be captured within the formed looped end of the strip in releasable connection therewith. Each elastic member 16 is formed from a suitable elastic material, such as a length of bungee cord type material, having its opposite ends secured together, such as shown at 16*a* in FIG. 3 to form a closed loop. By making the elastic member 16 of tubular elastic material, the opposite ends may be secured together by inserting one end within the other and affixing the ends by an adhesive or by a mechanical connection. Alternatively, a cylindrical connector sleeve or plug may be inserted within both adjacent ends of the elastic member and affixed thereto as by a suitable adhesive to secure the ends and form an endless elastic member.

In the preferred embodiment, a tubular grip member 14 is mounted on each of the elastic members 16 to facilitate hand gripping of the grip members to manipulate the fabric strip 12 as shown in FIG. 1. By applying hand forces sufficient to stretch the elastic members 16 and place the strip 12 in longitudinal tension, the contact pressure applied by the strip against the user's back during application of lotion or the like can be varied. The grip members or handles 14 are preferably made of a tubular foam rubber type material and have suitable axial passages to receive the corresponding elastic member 16 therethrough prior to securing the ends of the elastic member together. The grip members 14 are preferable positioned to cover the connected ends of the elastic members 16 in generally coaxial relation therewith.

After assembling the lotion applicator as thus described, a suitable body lotion or other solution, such as a body cleaning lotion, can be kneaded into a selected length or the full length of the fabric strip 12 and the strip manipulated across the user's back so as to apply lotion to the back by gripping the opposite handle ends in a manner as illustrated in FIG. 1. The elastic members 16 enable the user to apply axial forces to the fabric member in a direction to place the fabric member in tension and resiliently urge the fabric strip against the user's back to exert a desired contact pressure. At selected intervals of use, the fabric strip 12 may be readily detached from the elastic members 16 and associated handle grips 14 for washing the fabric strip.

Having thus described a preferred embodiment of the lotion applicator in accordance with the present invention, it will be understood that changes and modifications may be made therein without departing from the invention in its broader aspects. Various features of the invention are defined in the following claims.

What is claimed is:

1. An applicator for applying lotion to one's body, comprising, in combination, an elongated generally rectangular strip of flexible but relatively non-extendable woven material having opposite ends and oppositely facing surfaces, said material having a plurality of interstitial cavities within the material at least some of which communicate with at least one of said oppositely facing surfaces, a pair of hand-grippable handles, and an elastic member connecting each of said handles to one of said opposite ends of said strip, each of said opposite ends of said strip including means for releasably connecting one of said elastic members thereto, whereby a lotion may be applied to said at least one of said oppositely facing surfaces and then applied to one's body by grasping said handles and contacting the body with said at least one surface while grasping said handles to maintain said strip relatively taut.

2. An applicator as defined in claim 1 wherein said woven material comprises a microfiber fabric.

3. An applicator as defined in claim 1 wherein said elastic members comprise endless loops of an elastic material.

4. An applicator as defined in claim 3 wherein said handles comprise tubular shaped members made from sponge-like material and mounted coaxially on said endless loops of elastic material.

5. An applicator as defined in claim 1 wherein said elastic members are made from bungee cord.

6. An applicator for applying lotion to one's body, comprising, in combination, an elongated generally rectangular strip of flexible but relatively non-extendable woven material having opposite ends and oppositely facing surfaces, said material having a plurality of interstitial cavities within the material at least some of which communicate with at least one of said oppositely facing surfaces, a pair of hand-grippable handles, and an elastic member connecting each of said handles to one of said opposite ends of said strip, each of said opposite ends of said strip being adapted to be folded back upon itself and releasably secured thereto so as to form a loop about the corresponding elastic member whereby a lotion may be applied to said at least one of said oppositely facing surfaces and then applied to one's body by grasping said handles and contacting the body with said at least one surface while grasping said handles to maintain said strip relatively taut.

7. An applicator as defined in claim 6 wherein each of said opposite ends of said strip has fastener means thereon enabling said folded back ends to be releasably secured upon themselves.

8. An applicator as defined in claim 7 wherein said fastener means includes a fabric material having a surface of hook-like elements enabling folding and releasable attachment of said surface to itself.

9. An applicator as defined in claim 7 wherein said fastener means is selected from the group consisting of a fabric material having a surface of hook-like elements enabling folding and releasable attachment of said surface to itself, snap and button fasteners.

* * * * *